US006314593B1

(12) United States Patent
Mantel

(10) Patent No.: US 6,314,593 B1
(45) Date of Patent: Nov. 13, 2001

(54) SANITARY FITTING

(75) Inventor: Ralf Mantel, Schiltach (DE)

(73) Assignee: Hansgrohe AG, Schiltach (DE)

( * ) Notice: Subject to any disclaimer, the term of this patent is extended or adjusted under 35 U.S.C. 154(b) by 0 days.

(21) Appl. No.: 09/439,649

(22) Filed: Nov. 12, 1999

(30) Foreign Application Priority Data

Nov. 18, 1998 (DE) ..... 198 53 139

(51) Int. Cl.[7] ..... E03C 1/04

(52) U.S. Cl. ..... 4/695; 4/678; 4/696; 137/801; 403/12

(58) Field of Search ..... 4/695, 696, 675, 4/678; 403/12, 11, 372; 248/65; 137/360, 801

(56) References Cited

U.S. PATENT DOCUMENTS 3,427,049 * 2/1969 Politz ..... 4/695 X
3,726,318 * 4/1973 Hyde ..... 137/801 X
4,037,624 * 7/1977 Turner et al. ..... 137/801 X
4,762,437 * 8/1988 Mitomi ..... 403/11
4,848,395 * 7/1989 Krippendorf ..... 137/801 X
5,148,902 * 9/1992 Nakamura ..... 403/372 X

FOREIGN PATENT DOCUMENTS 40 30 765 4/1992 (DE) .
44 43 668 6/1996 (DE) .
1004044 * 9/1965 (GB) ..... 403/372

* cited by examiner

*Primary Examiner*—Gregory L. Huson
*Assistant Examiner*—Kathleen J. Prunner
(74) *Attorney, Agent, or Firm*—Duane Morris

(57) ABSTRACT

A sanitary fitting having a plastic holding part inserted in the underside of the fitting for rigidly fixing the fitting to a surface. The fitting has a holding part containing passages for leads and optionally fastening parts. The holding part has a holding tongue on a side remote from the center of gravity of the fitting, the holding tongue engages with a projection on the underside of a plate to which the fitting is to be firmly screwed. This holding tongue prevents tilting of the fitting.

15 Claims, 3 Drawing Sheets

SANITARY FITTING

BACKGROUND OF THE INVENTION

Field of the Invention

Wash table fittings contain a fitting body intended to be fixed with a standing face to an at least approximately horizontal surface, through which is passed the lead for the fitting. Other fittings can also be installed on planar surfaces. Such fittings are referred to hereinafter as standing fittings.

SUMMARY OF THE INVENTION

The problem of the invention is to so improve a sanitary fitting that it can be more easily installed.

For solving this problem the invention proposes a sanitary fitting having a holding element having a holding tongue.

The holding element, during the manufacture of the fitting, is e.g. inserted from below into the fitting body and fixed. The holding element leaves a passage free for the lead. The holding element is fitted in such a way that the holding tongue is located on the fitting side remote from the center of gravity and normally on the side remote from the discharge spout. On installing the fitting the holding tongue passes through the opening of the fixing surface and can prevent tilting of the fitting, which could occur if the center of gravity of the fitting was outside the standing face. As a function of the strength and surface characteristics of the holding tongue a straight configuration can be sufficient to prevent said tilting. In particular, the holding tongue can be formed by a circumferential portion of a skirt or apron, which passes round part of or the entire circumference. Tilting is prevented by the corresponding dimensioning in that said skirt is only partly deformed.

The fixing to the fitting can e.g. take place by providing a rigid fit along a surface, e.g. a circumferential surface. The holding part is then inserted from below, whilst exerting a force.

Another possibility consists of fixing the holding part by snapping in.

Thus, a deformation and an undercut are used in order to perform the snap-in process.

According to a further development of the invention, on the plate side directed out of the fitting is fitted a spigot, which is smaller than the standard sizes of openings in the basin fixture, wash stand or other surface to which the fitting is to be fitted. The spigot only needs to protrude by a few millimeters. It consequently enables the fitter to align the fitting with respect to the opening without being able to be able to precisely observe it.

The holding tongue can have a projection on its outwardly directed side and this forms a holding shoulder facing the fitting. On tilting the holding shoulder engages on the underside of the wash stand, so that further tilting is prevented.

The holding projection can in particular be located in the vicinity of the end of the holding tongue.

According to the invention, it is also possible for the holding tongue to have several projections, whose length increases with increasing distance of the projection from the plate element. This permits an adaptation to different plate thicknesses. The outside of the holding tongue can have a stepped form.

Another possibility proposed by the invention consists of fitting several juxtaposed holding tongues to the plate.

The holding tongues can have different lengths, e.g. three holding tongues with three different lengths.

It is also possible in the case of several holding tongues, to arrange the projections with different distances from the standing face.

BRIEF DESCRIPTION OF THE DRAWINGS

Other features, details and advantages of the invention can be gathered from the following description of a preferred embodiment with reference to the attached drawings, wherein show.

DETAILED DESCRIPTION OF THE PREFERRED EMBODIMENTS

Figure 1:
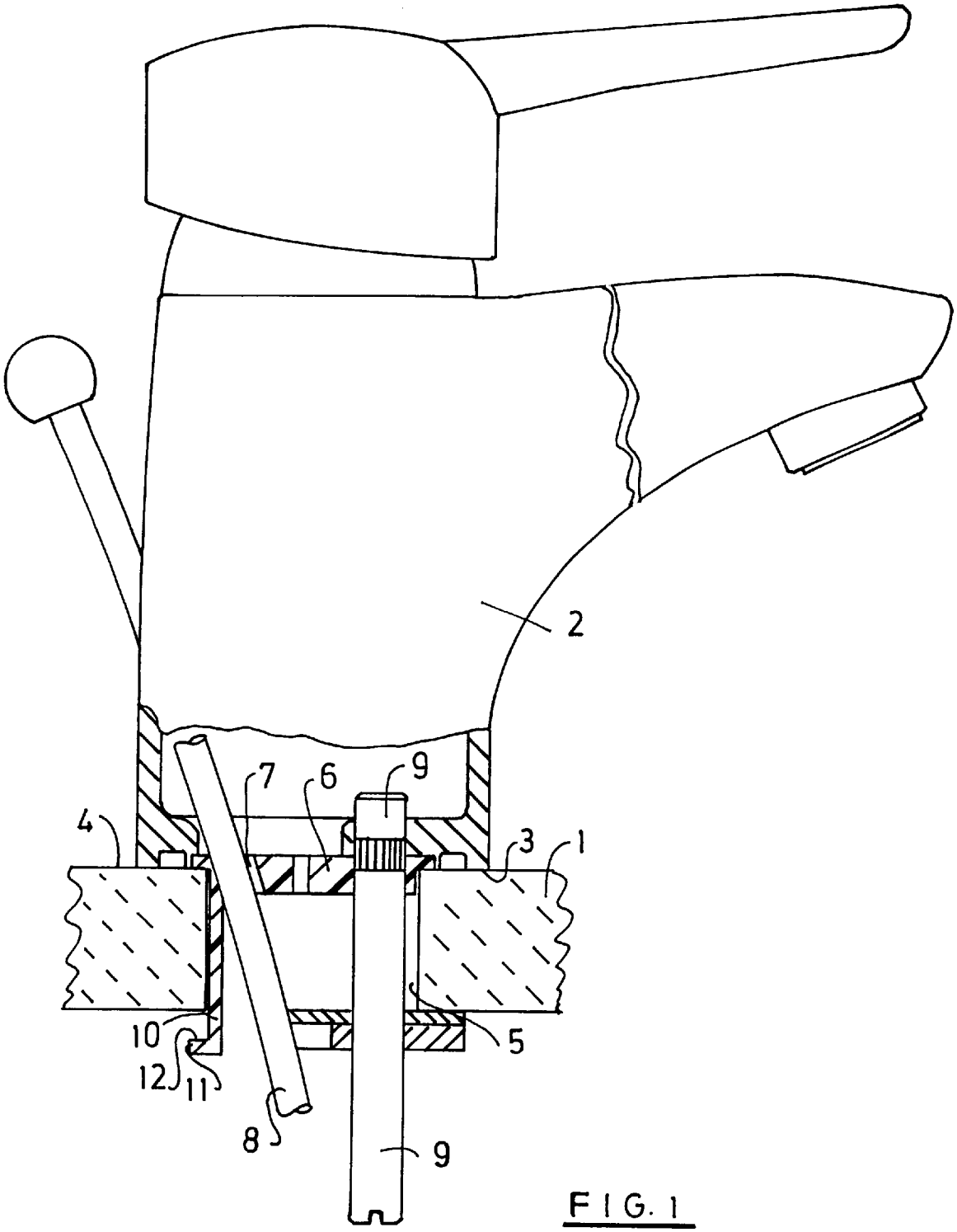
FIG. 1 A part sectional view of a sanitary fitting according to the invention.

A fitting 2 is to be fixed to a wash stand 1. The fitting 2 has a standing face 3, which is to rest on the surface 4 of the wash stand 1. All leads and fastenings take place through a hole 5 in the wash stand 1. The fitting 2 is dimensioned in such a way that the hole 5 is invisible when the fitting is installed.

In the vicinity of the standing face the holding element 6 is fixed to the fitting, e.g. in that it is inserted in the opening formed there. In the represented embodiment the holding element 6 has an opening 7 for an actuating rod 8, with which e.g. a drain can be opened or closed. The holding element 6 has a further opening for the passage of a threaded rod 9, which is screwed into part of the sanitary fitting 2 and is provided from below with a nut. The threaded rod 9 forms the actual fastening of the sanitary fitting. The main function of the holding element 6 occurs during the fixing of the fitting 2.

In FIG. 1 the discharge spout is located to the right. On the side remote from the discharge spout the holding element 6 has a holding tongue 10, which in the installed position passes the opening 5 of the wash stand 1. In the vicinity of its end the holding tongue 10 contains a projection 11, which on its side facing the fitting 2 forms a holding shoulder 12. When the fitting has not yet been fixed, it can only tilt to the right until the holding shoulder 12 engages on the underside of the wash stand 1.

Figure 2:
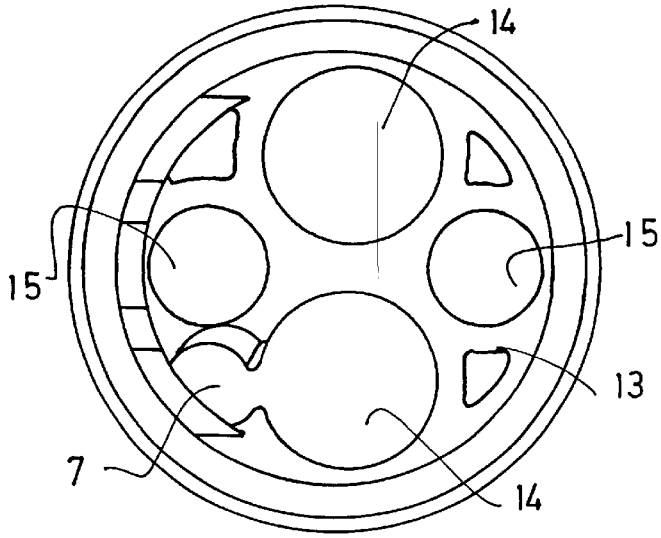
FIG. 2 A plan view of a holding element of the sanitary fitting.

FIG. 2 is a view of the holding element, which contains a roughly planar plate 13. The plate has a circular outer circumference corresponding to the inner shape of the sanitary fitting. In the plate are formed two large openings 14 for the leads, an already mentioned opening 7 for the passage of an actuating member for a drain, as well as two further openings 15, whereof one is intended for the passage of the threaded rod 9.

Figure 3:
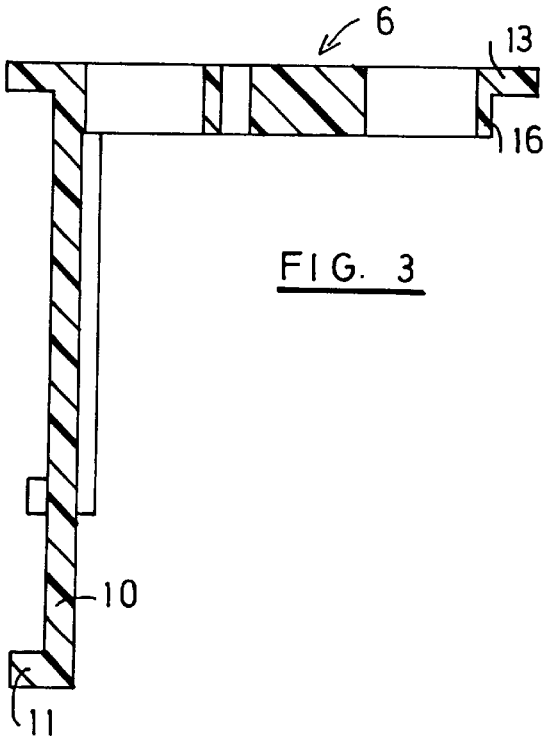
FIG. 3 A cross-section through the holding element of FIG. 2.

FIG. 3 shows in a cross-section through the holding element 6 that on the plate 13 is formed a downwardly directed spigot 16. The term underside is used to define that side of the holding part 6 which is remote from the fitting 2. The spigot 16 is so constructed that when the holding part 6 has been inserted in the fitting 2, cf. FIG. 1, it projects with respect to the standing face 3 of said fitting 2. Thus, it can serve to carry out a centering of the fitting prior to its fixing.

In the represented embodiment there are three holding tongues 10, which in each case have on their lower end the projection 11, are shaped onto the underside of plate 13. All three holding tongues are located in the vicinity of the left-hand side of the holding element 6 in FIGS. 2 and 3, i.e. roughly in the area facing the point where the fitting 2 has its center of gravity. The three holding tongues are juxtaposed, but are not interconnected. As a function of the thickness of the plate to which the fitting 2 is to be fixed, one of the three holding tongues can provide security against tilting. If it is the longest holding tongue 10, the two others can remain inwardly deformed. It is obviously also possible for the fitter to remove the holding tongues prejudicial to him.

Figure 4:
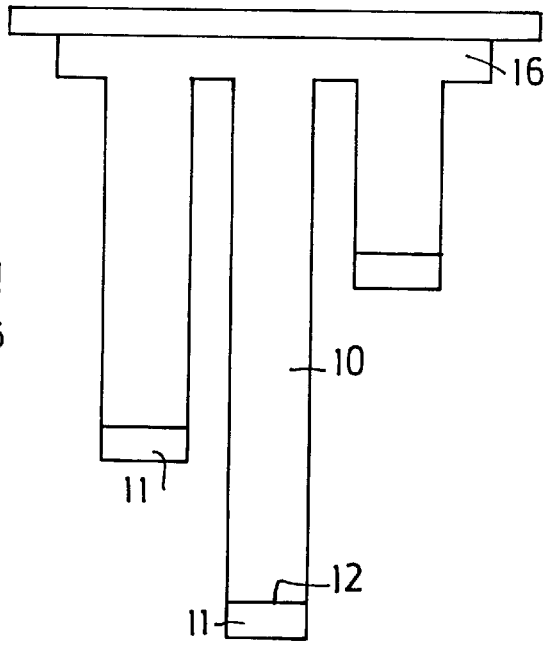
FIG. 4 A side view of the arrangement of FIGS. 2 and 3 from the left.
Figure 5:
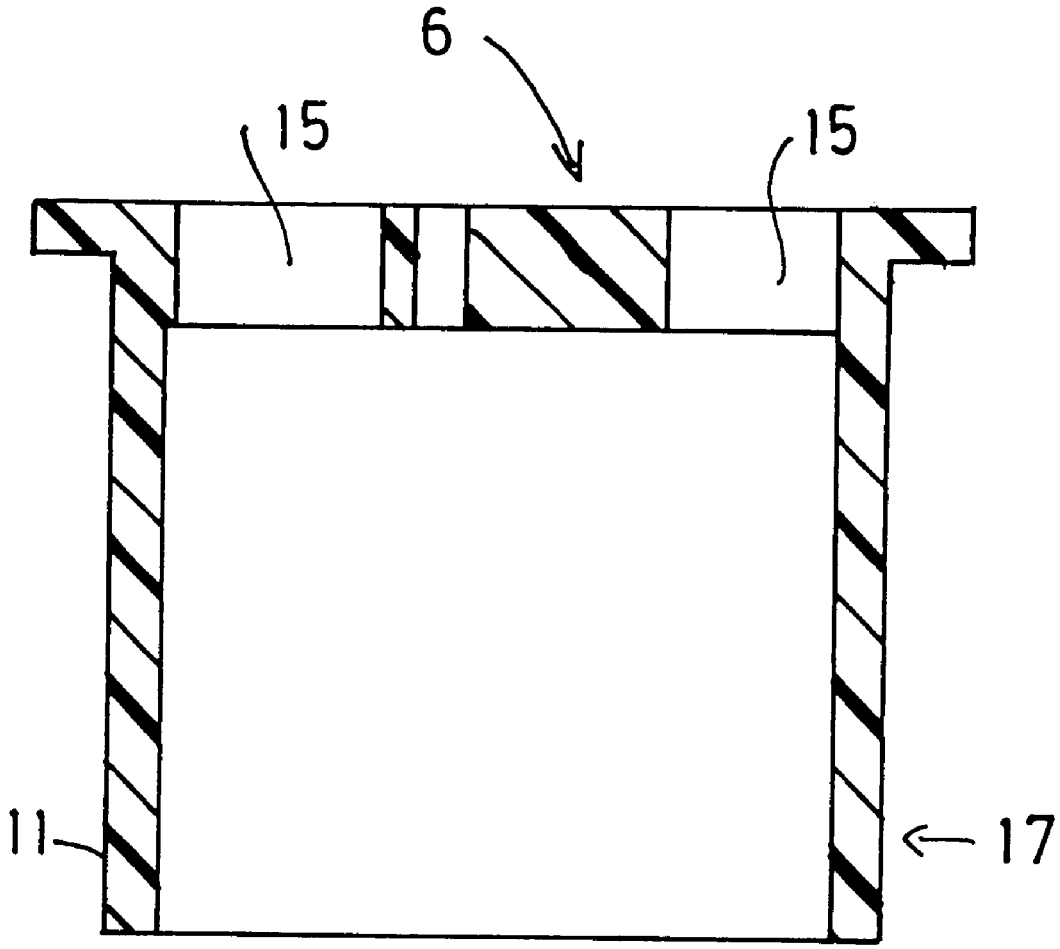
FIG. 5 A representation of a further embodiment corresponding to FIG. 3.

FIG. 5 shows a cross-section through a second embodiment. Once again the holding element 6 is plate-like and has openings 15 for the passage of lines, leads, etc. Concentric to its circular edge is fitted a lug, which has a similar diameter to the spigot 16 of the embodiment of FIG. 3. However, the lug is axially longer and forms a circumferential skirt 17, which has a cylindrical construction. It has an axial length roughly corresponding to the length of the central holding tongue 10 in FIG. 4. In the embodiment shown there are no projections 11 on the outside of the skirt 17. Tilting is prevented in that in the case of an inclined position the entire skirt must be deformed and said deformation is resisted. With a corresponding hardness there is merely a certain inclination of the skirt 17 without a true deformation occurring.

It can be sufficient if the skirt 17 e.g. only extends over half the circumference and the arc length of the skirt 17 being variable over the fitting spacing.

In the embodiment of FIG. 5 it is possible by corresponding dimensioning to also ensure that the skirt 17 can be relatively short, because it need not necessarily pass entirely through the plate.

What is claimed is:

1. A sanitary fitting, comprising:

a fitting body adapted to be mounted in a hole extending through a surface, the fitting body having a standing face for placement against the surface;

a holding element fixed to the fitting body in a vicinity of the standing face, the holding element having a planar portion adapted to extend across and fill said hole, the holding element being adapted to support the fitting body in the hole, the holding element having a portion projecting from the planar portion and adapted to project into the hole, the planar portion of the holding element defining at least one opening adapted to be located over said hole, wherein the projecting portion of the holding element defines a holding tongue that extends roughly perpendicular to the planar portion of the holding element and is adapted to fit in a marginal area of the hole, so as to support the fitting body against tilting during fixing of the fitting body to the surface.

2. The sanitary fitting of claim 1, wherein the opening defined by the holding element is adapted to be sized for an actuating rod.

3. The sanitary fitting of claim 1, wherein the holding element is adapted to fit tightly against the surface.

4. The sanitary fitting of claim 1, wherein the planar holding element is adapted to be sized to snap into the hole.

5. The sanitary fitting of claim 1, wherein the holding tongue has an outwardly extending projection forming a holding shoulder.

6. The sanitary fitting of claim 5, wherein the projection is adjacent to an end of the holding tongue.

7. The sanitary fitting of claim 1, wherein the planar holding element has a plurality of projections extending from the projecting portion and forming holding shoulders at increasing distances from the planar portion of the holding element.

8. The sanitary fitting of claim 7, wherein the plurality of projections are provided on a plurality of holding tongues having different lengths.

9. The sanitary fitting of claim 1, wherein the holding tongue is formed by a portion of a skirt adapted to extend over at least part of a circumference of the hole.

10. A holding element for a sanitary fitting provided with a fitting body to be mounted in a hole on a surface, the fitting body having a standing face for placement against the surface, the holding element comprising:

a planar portion adapted to be fixed to the fitting body in a vicinity of the standing face and adapted to extend across and fill said hole, the holding element having a portion projecting from the planar portion and adapted to support the fitting body in the hole, the planar portion of the holding element defining at least one opening adapted to be located over said hole, and the projecting portion defines a holding tongue that extends roughly perpendicular to the planar portion and fits in a marginal area of the hole, so as to support the fitting body against tilting during fixing of the fitting body to the surface.

11. The holding element of claim 10, wherein the projecting portion comprises a projection forming a holding shoulder.

12. The holding element of claim 11, wherein the projection is adjacent to an end of the holding tongue.

13. The holding element of claim 11, wherein the projecting portion of the holding element has a plurality of projections forming holding shoulders at increasing distances from the planar portion of the holding element.

14. The holding element of claim 13, wherein the plurality of projections are provided on a plurality of holding tongues having different lengths.

15. The holding element of claim 11, wherein the holding tongue is formed by a portion of a skirt adapted to extend over at least part of a circumference of the hole.

* * * * *